United States Patent [19]

Gilbertson

[11] Patent Number: 4,592,554

[45] Date of Patent: Jun. 3, 1986

[54] EQUIPMENT FOR SIMULATED SHOOTING

[76] Inventor: Peter Gilbertson, Manor Farm House, Garriston, Leyburn, North Yorkshire DL8 5JT, United Kingdom

[21] Appl. No.: 596,401

[22] Filed: Apr. 3, 1984

[30] Foreign Application Priority Data

Apr. 5, 1983 [GB] United Kingdom ..... 8309229

[51] Int. Cl.[4] ..... F41J 5/02

[52] U.S. Cl. ..... 273/312; 434/22

[58] Field of Search ..... 273/310, 312, 359, 365; 434/21, 22

[56] References Cited

U.S. PATENT DOCUMENTS

| | | | |
|---|---|---|---|
| 3,655,192 | 4/1972 | Hall et al. | 273/310 |
| 3,907,433 | 9/1975 | Nault | 434/22 |
| 4,086,771 | 5/1978 | Gammarino et al. | 273/310 |
| 4,210,329 | 7/1980 | Sterger et al. | 273/312 |
| 4,363,484 | 12/1982 | Breslow et al. | 273/312 |

*Primary Examiner*—Richard C. Pinkham
*Assistant Examiner*—Vincent A. Mosconi
*Attorney, Agent, or Firm*—Wegner & Bretschneider

[57] ABSTRACT

Equipment to simulate the firing of at least one projectile from a gun at a target such that a beam of electromagnetic radiation replaces the projectile trajectory. A hand held simulator includes a projector for generating such a beam of light, the power of which is no greater than 40 mW, in response to the operating of a trigger. If aimed correctly at the target, which is retroreflective, the beam is reflected back to the equipment and the reflected beam is received by a receiver which includes a collection of components connected in series. In view of the low power of the beam and the large distance over which the equipment is designed to operate, the components forming the receiver are designed to differentiate a fairly weak signal form the background light. The equipment may form part of a system of two or more simulators and a score unit in which a "hit" signal obtained at the receiver of a simulator is radiated to the score unit and the score is incremented for each simulator or team of simulators separately from the incremented score for other simulators.

3 Claims, 4 Drawing Figures

EQUIPMENT FOR SIMULATED SHOOTING

The present invention relates to equipment for simulated shooting in which the use of a firearm is simulated by replacing bullets or cartridges by a beam of radiation.

Experiments are currently taking place with a system in which bullets are replaced with a laser beam emitting device. The human target wears a jacket which incorporates sensors for indicating incidence of the laser beam on the jacket, and hence a "hit". Problems have been encountered in this system with the accuracy of recording "hits".

U.K. Patent specification No. 1,595,189 describes an installation for simulated shooting and illustrates an arrangement including a rifle and a stationary target. The weapon is provided with a laser or L.E.D. pulse emitting device and optical provision is made for adjusting the width of the beam to the calibre of the weapon in the plane of the target. In this case the weapon is stationary during firing and the target is stationary and at a known distance away. The target includes sensors for detecting a "hit".

This prior disclosure does not provide a solution for the problems which arise in simulating a moving weapon and /or a moving target, such as might be experienced, for example with clay pigeon shooting.

OBJECT OF THE INVENTION

It is the object of the invention to provide equipment for simulated shooting in which it is possible to use a moving target, and/or a moving weapon.

STATEMENT OF INVENTION

According to the present invention there is provided equipment for simulated shooting comprising a projector having a trigger, means for generating a modulated beam of electromagnetic radiation and projecting it towards a target in response to operation of the trigger, and receiver means for sensing incidence of the beam on the target and signaling a "hit", wherein the target comprises a reflective surface operable to reflect the beam back along a path substantially parallel to the incident beam irrespective of the angle of incidence of the beam; and the receiver means is adapted to detect radiation reflected from the target.

Advantageously the equipment includes means for timing and comparing the projected and received beams including means for detecting the operation of the trigger.

Preferably the equipment includes a score unit comprising a signal processor and visual display means, the equipment including means for radiating signals from said receiving means to said score unit on receipt of a reflected beam, said score unit being adapted to increment the score reading on the visual display means in response to a signal from the receiver means.

The "hit" indicator may be electrically connected to the receiver or remote from the receiver but activated thereby.

Means may optionally be provided to cater for differences which may arise owing to the different nature of the radiation beam and the projectile which it is to simulate. For example the beam may be diverged to simulate the spread of pellets from the muzzle of a shot gun, or may be deflected to cater for the difference in the speed of travel of radiation and the projectile to be simulated.

The equipment could be specifically made for simulated shooting, or alternatively the projector could be mounted in a firearm which is normally used with ammunition, which is thus temporarily adapted for simulated shooting.

SPECIFIC DESCRIPTION OF PREFERRED EMBODIMENTS

Figure 1:
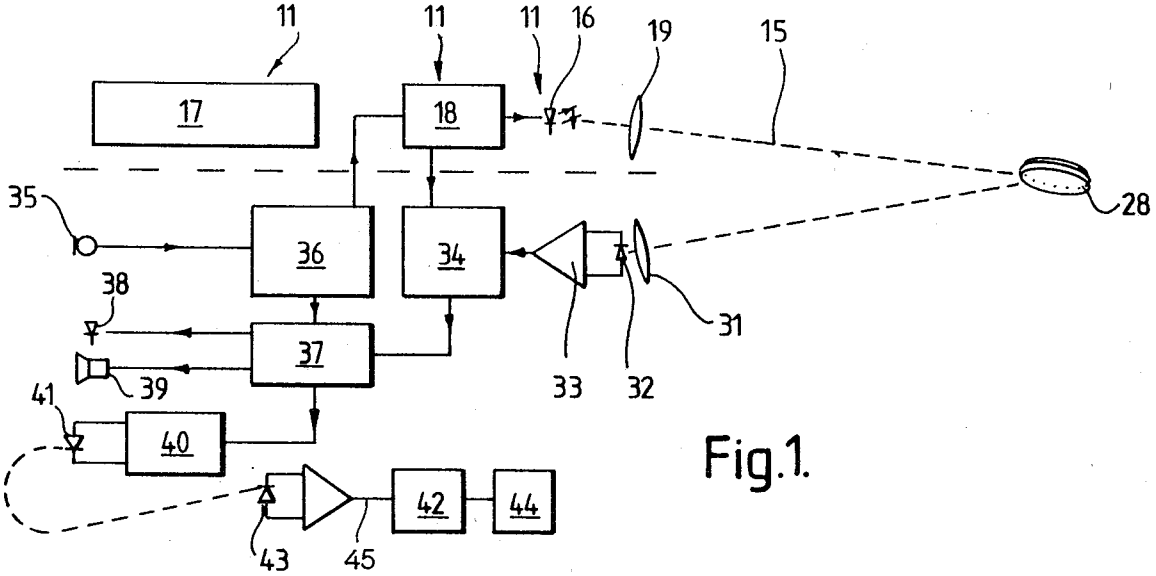
FIG. 1 is a block diagram illustraing equipment for simulated shooting according to one embodiment of the invention.
Figure 2:
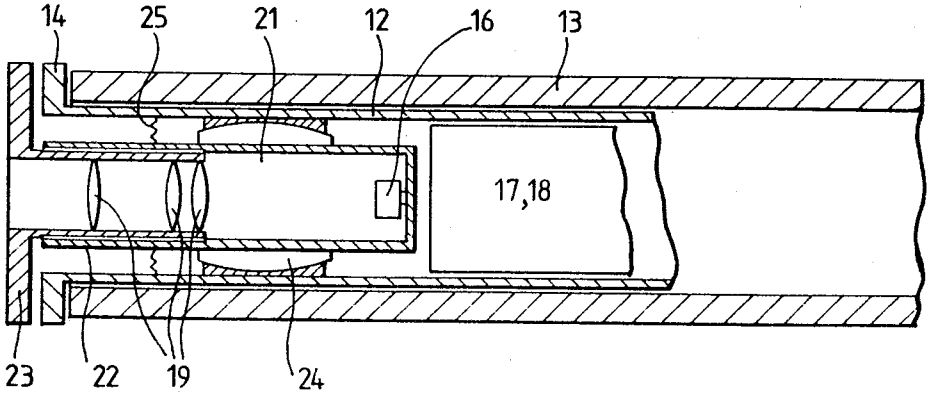
FIG. 2 is a cross-section of a barrel of a firearm fitted with a projector for use in the equipment of FIG. 1.

The equipment illustrated simulates the firing of one or more projectiles from a gun at a target such that a light beam replaces the projectile trajectory. A solid state laser or pulsed light emitting source mounted in a barrel of the gun projects a narrow beam of light, in response to operation of the trigger, towards the target which is coated with reflective material. If the beam intersects the target reflected light is detected by a sensor located in the vicinity of the user, and preferably in or on the gun. An indication is then given that a "hit" has been made.

Although the embodiments described relate to the simulation of the use of a shot gun, it will be appreciated that a similar system could equally well be used to simulate other firearms.

A projector 11 has a cylindrical housing 12 which can be fitted into one barrel 13 of a shot gun up to an abutment ring 14 on the housing which locates the projector in the barrel. In response to operation of a trigger (not shown), the projector 11 generates a beam of light 15 from a source or emitter 16 in the form of a high density pulsed LED or semiconductor laser diode having a power of the order of 40 mW. The source 16 is powered by dry cell batteries 17 and the output is modulated, for example to 20 KHz by a modulator 18. The modulator 18 and the batteries 17 are located behind the source 16 in the housing 12. The beam 15 is collimated by a small diameter low power microscope objective lens, or an equivalent lens or lens system 19.

The lenses 19 are mounted in a cylindrical beam guide 21 and the source 16 is mounted at the back of a cylindrical beam guide 22, which is screw threaded to the guide 21. Rotation of a ring 23 at the outer end of the guide 21 thus alters the axial distance between the source and the lens system 19 and hence the focal point of the lens system. This adjustment may be effected to adjust to the choke of the barrel and to create a divergence of the beam 15 to simulate the spread of pellets from the muzzle of a shot gun. The beam angle adjustment required for a shot gun is between 0.76° and 1.05° to represent minimum and maximum chokes.

Figure 3:
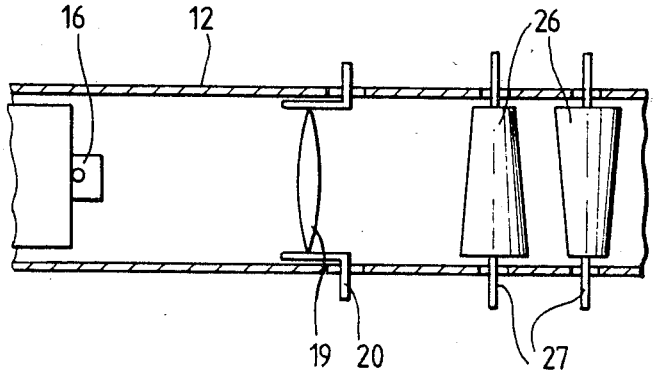
FIG. 3 is a similar view to FIG. 2 of a second projector for use in the equipment of FIG. 1.
Figure 4:
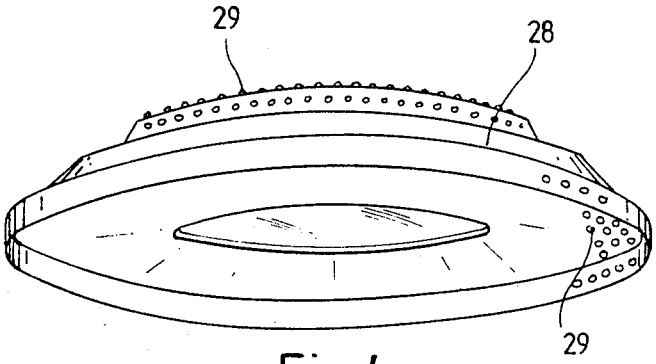
FIG. 4 is a perspective view of a target, being part of the equipment of FIG. 1.

Alternatively the arrangement of FIG. 3 could be used. In this embodiment a single lens 19 is moved axially with respect to the source 16 by axial movement of a ring flange 20 connected to the lens.

A light beam actually travels faster than the shot that it is to simulate. To enable the equipment more exactly to simulate a projectile trajectory, the optics will preferably incorporate compensation for this. Although it would be possible to cater for the difference in speed by delaying the firing of the light beam after the trigger has been operated so that the beam 15 reaches the target at the same time as the projectile would have done, this has a draw back in that the marksman would need to track the target steadily throughout the delay time after firing. The present system is designed to deflect the beam 15 so that the target is only illuminated by the light beam 15 if the projector is pointed the correct distance ahead of the target to allow for projectile speed. In the case of a clay target there is a reasonably defined trajectory and speed profile therefore the angular velocity of the projector could be used to determine the deflection requried. The system described hereinafter is adapted to deflect the beam 15 by up to 4° behind the aim of the projector, a preferred deflection being 3.2° to 3.6° for simulating shot.

The beam guides 21,22 are mounted within a ball joint arrangement 24, which is itself attached to the housing, such that angular acceleration would cause the guides 21,22 to twist slightly against the motion of the gun so that the guides 21,22 are no longer coaxial with the housing 12. The twist or movement is resisted by springs 25 or an elastic compound fitted between the guide 22 and the housing 12 which causes the guides 21,22 to return to their normal position when movement of the gun had ceased. The ball joint 24 is lubricated with a light grease which would integrate the acceleration induced forces and provide deflection roughly proportional to velocity during the aiming period. In this arrangement the emitter 16 and the lens system 19 would all move together.

Alternatively a separate lens or lens system could be used instead, as shown in FIG. 3. In this embodiment a beam refractor in the form of two thin deflecting prisms 26 are mounted in the path of the beam 15 in the housing 12. Both prisms are independently manually pivotable to create a deflection of the beam behind the aim of the gun according to the direction from which the clay will travel. The mechanism for pivoting the prisms 26 consists of respective adjusting rings 27 located outside the barrel which are rotatable to an appropriate position in the same way that the lens aperture is adjusted on a camera. Another possible solution is to provide a moveable aupport for the emitter 16, the lens system 19,26 remaining stationary. By moving the emitter 16 by a small amount the incident angle of the beam 15 on the refractor 26 is adjusted without moving the lens system.

Another problem with simulating the use of a shot gun is that there is a stringing time for the shot, i.e. the shot is spread out over a finite distance in length. To cater for this, either the light emission is of a predetermined period, or alternatively actuation of the trigger will modulate the light emission for the same period. At a range of 45 m, the shot cloud passes the target in approximately 60 msecs. The duration of the emission is designed to represent this passage time. The proposed 20 KHz modulation caters for this.

All the beam projection mechanism and optics is designed to be removeably fitted into a barrel of the shot gun. A receiver for the reflected beam may be located in the other barrel.

A target 28 which is in the shape of a clay pigeon, and is designed for ejection by similar launching equipment, is made of a tough and durable plastics material which is injection moulded to the required shape. To be useful as a target, the clay must remain a dark colour so that it is silhouetted against the sky. Therefore the reflective coating applied to the clay must be one that reflects the beam 15 without significantly altering what the marksman sees.

To create a reflective surface to the projected signal beam 15, reflective elements in the form of substantially spherical or polygonal reflective beads 29 loaded into a fixing medium are applied to the surface of the target. These beads mainly reflect light back along the path from which it came irrespective of the angle of the reflecting surface to the incident light. Because of this property, the paint has a dark matt finish when observed under diffuse lighting conditions and therefore appears as a black object to the marksman when viewed agaisnt the sky. A reflective paint such as that sold under the Trade Mark "Scotchlite" is considered suitable.

Such targets can be reused, and could be fitted with means assisting recovery after use.

A receiver for the reflected light from the target 28 is mounted in or on the gun. Where the beam projector is in one barrel and the receiver in the other a link bridge for power and signal wires connects across the open ends of the barrels. The receiver comprises an optical band pass filter (not shown) which may be placed before or after a focusing lens 31, which filter limits the light entering the receiver to a limited wave-band, thus improving the signal to noise ratio. The beam is focused by the lens 31 on to a small photodetector such as a pin photodiode 32. The lens 31 is of maximum practical aperture such that the maximum transmitted beam deflection angle is catered for. A field effect transistor 33 amplifies the received signal at the detector 32 and a synchronous demodulator such as a phase locked loop detector 34 allows passage only of signals synchronous with the transmitted beam, in this case 20 KHz. As a further insurance against receiving stray signals, a small piezo electric microphone 35 mounted in the receiver barrel of the gun detects the operation of the trigger and in response activates a timer 36. The timer 36 opens a gate 37 for a period sufficient for the simulated shot cloud travel time, for example 60 msecs. Received signals passing through the demodulator 34 will only be able to pass the gate 36 during this time. The received signal, having passed the gate 36 may be used to activate either or both of a piezo electric sounder 38 and a visible indicator 39. The signal once through the gate 36 can also be used to activate an electrical or radio controlled link to a score unit whereby automatic scoring can be achieved. An encoding integrated circuit 40 is provided for this purpose. The indicators 38, 39 would be positioned at the open end of the barrel. Optionally a low noise detector circuit (not shown ) could be included immediately after the photodetector 32.

The signal detecting capacity of the receiver can further be improved by blooming all the optical components to have minimum reflection coefficient.

For a single marksman or in a friendly match no score unit is necessary. But in a competitive environment it is advantageous to provide a score unit including visual display means 44 on which the number of "hits" attained by a person or team is automatically displayed, together with any other information that may be required. While this can be achieved using a direct receiving aerial, this would entail the use of a higher power emitter 16. A more reliable display would be recorded be creating a link with each gun so that the result of any successful shot detected at the gun can be incremented on the score unit automatically.

To avoid the chance of confusion as to the identification of the gun that scored the "hit", it would be possible for different guns to use emitted signals of different frequencies or characterisations.

It is envisaged that the occurrence of a "hit" would be radiated to the score unit by a second light emitting source 41 emitting an infra red light signal on detection of a "hit". This source 41 would be mounted on the underside of the barrels pointing roughly downwards.

An infra-red detector 43 mounted within a small enclosure, say 10 mm diameter, and lying on the ground in front of the marksman would receive the radiated signal and, provided that the pattern fitted a pre-set arrangement, a signal would be sent from the enclosure by a signal wire 45 to the score unit to be received by a micro-computer 42 or other signal processor. The micro-computer would associate with an infra-red detector, a high gain amplifier chip, a decoding integrated circuit and a circuit for transmitting the signal back through a current loop connection to the microcomputer. If more than one detector is required they may be connected either separately to the micro-computer 42 in a star configuration, or by means of a ring circuit. Once processed, the score is displayed or printed out on the visual display unit 44, which forms part of the score unit.

The system described not only reduces the running costs normally incurred in the sport of clay pigeon shooting by obviating the need for cartridges and disposable clays, but will also create little noise, therefore allowing the sport to take place in urban areas, and perhaps even indoors.

Although it would be possible to use a light source remote from the projector with a cable to the projector and a gate connected to the trigger, by using a low power source in the projector and by radiating signals to the score unit the projector is completely free of connecting cables. This makes the system more flexible, and there is less chance of accidents occurring from tripping over wires.

I claim:

1. Hand held epuipment for simulating the shooting of a weapon, said equipment comprising a projector, a target, means for generating a beam of electromagnetic radiation and projecting said beam towards said target in response to operation of said trigger, and receiver means for sensing incidence of said beam on said target and signalling a "hit"; wherein (i) said means for generating a beam of electromagnetic radiation has a power no greater than 40 mW, is adapted to generate a modulated beam, and includes means for transmitting said beam as a pulse of predetermined duration in response to each operation of said trigger;

(ii) said target comprises a reflective surface operably situated to reflect said beam back along a path substantially parallel to said incident beam irrespective of the angle of incidence of the beam; and (iii) said receiver comprises the following components operable in series, an optical band pass filter, a photodetector, an amplifier for amplifying the signal received at said photodetector, a synchronous demodulator for excluding all but signals of substantially the same frequency and phase as said emitted beam, an electrical gate, means for detecting the operation of said trigger, and a timer activated by said means for detecting the operation of said trigger and connected to operate said electrical gate after a predetermined time, signals being forwarded to said "hit" indicator only when said gate is open; said equipment further comprising optical means resiliently mounted in the path of said beam and capable of responding automatically to movement of said projection immediately before firing with movement of said optical means to direct said beam behind the aim of said projector to account for the difference in speed of travel of said radiation and the projectile that it is to simulate, said resilience acting to return said optical means to its original position after said projector is still.

2. The equipment of claim 1 wherein said optical means comprises a system of lenses for adjusting the spread of said beam.

3. Equipment for comparing shooting skills comprising a plurality of pieces of hand held equipment according to claim 1 and a score unit comprising a signal processor and a visual display means, each piece of hand held equipment including means for radiating signals indicating a "hit" from said receiver means to said score unit, said score unit having means for identifying the piece of hand held equipment from which said radiated signal is sent and being adapted to increment the score reading for that piece of hand held equipment in response to a signal from the receiver means thereof.

* * * * *